US008251767B2

(12) United States Patent
Gordin et al.

(10) Patent No.: US 8,251,767 B2
(45) Date of Patent: Aug. 28, 2012

(54) APPARATUS AND METHOD FOR ELIMINATING OUTGASSING OF SPORTS LIGHTING FIXTURES

(75) Inventors: Myron Gordin, Oskaloosa, IA (US); Timothy J. Boyle, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

(21) Appl. No.: 13/155,210

(22) Filed: Jun. 7, 2011

(65) Prior Publication Data

US 2011/0296670 A1 Dec. 8, 2011

Related U.S. Application Data

(60) Division of application No. 12/394,922, filed on Feb. 27, 2009, which is a continuation of application No. 11/334,141, filed on Jan. 18, 2006, now Pat. No. 7,527,393.

(60) Provisional application No. 60/644,638, filed on Jan. 18, 2005, provisional application No. 60/644,639, filed on Jan. 18, 2005, provisional application No. 60/644,536, filed on Jan. 18, 2005, provisional application No. 60/644,747, filed on Jan. 18, 2005, provisional application No. 60/644,534, filed on Jan. 18, 2005, provisional application No. 60/644,720, filed on Jan. 18, 2005, provisional application No. 60/644,688, filed on Jan. 18, 2005, provisional application No. 60/644,636, filed on Jan. 18, 2005, provisional application No. 60/644,517, filed on Jan. 18, 2005, provisional application No. 60/644,609, filed on Jan. 18, 2005, provisional application No. 60/644,516, filed on Jan. 18, 2005, provisional application No. 60/644,546, filed on Jan. 18, 2005, provisional application No. 60/644,547, filed on Jan. 18, 2005, provisional application No. 60/644,537, filed on Jan. 18, 2005, provisional application No. 60/644,637, filed on Jan. 18, 2005, provisional application No. 60/644,719, filed on Jan. 18, 2005, provisional application No. 60/644,784, filed on Jan. 18, 2005, provisional application No. 60/644,687, filed on Jan. 18, 2005.

(51) Int. Cl.
*H01J 9/00* (2006.01)

(52) U.S. Cl. ..... 445/59; 445/66; 445/23

(58) Field of Classification Search ..... 445/59, 445/66, 23; 362/267
See application file for complete search history.

(56) References Cited

U.S. PATENT DOCUMENTS

| | | | | |
|---|---|---|---|---|
| 2,447,923 | A | 8/1948 | Tuck | |
| 3,337,763 | A | 8/1967 | Aronson et al. | |
| 3,551,667 | A | 12/1970 | Husby et al. | |
| 3,695,009 | A * | 10/1972 | Osteen | 362/267 |
| 3,988,626 | A | 10/1976 | Boudouris et al. | |
| 4,029,955 | A * | 6/1977 | Tart | 362/267 |
| 4,371,224 | A * | 2/1983 | Murphy et al. | 445/72 |

(Continued)

FOREIGN PATENT DOCUMENTS

EP 1158567 A 11/2001

(Continued)

*Primary Examiner* — Mariceli Santiago
(74) *Attorney, Agent, or Firm* — McKee, Voorhees & Sease, P.L.C.

(57) ABSTRACT

An apparatus and method for reducing lumen depreciation caused by other than lamp lumen depreciation. In one aspect, manufacturing and assembly of the fixture uses clean-room light techniques. In another aspect of the invention, materials that have a propensity to outgas are shielded from direct exposure to light energy. Other aspects of the invention include other methodologies to eliminate causes for lumen depreciation.

6 Claims, 14 Drawing Sheets

U.S. PATENT DOCUMENTS

Figure 1A:
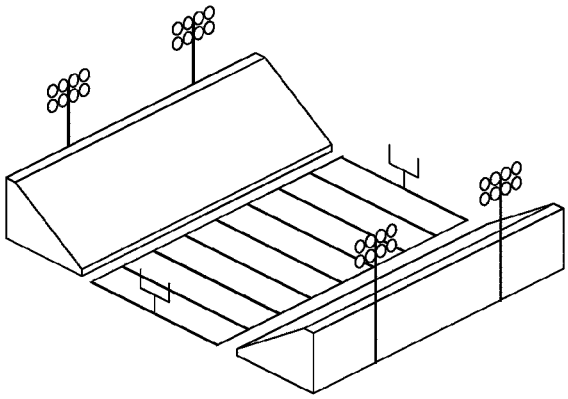
Figure 1B:
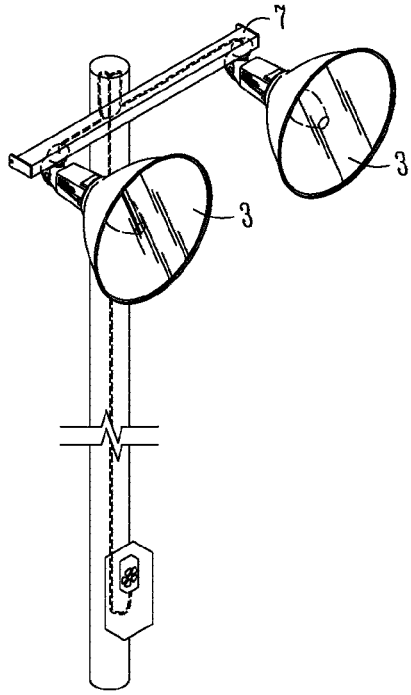

| | | | |
|---|---|---|---|
| 4,450,511 | A | 5/1984 | Micha et al. |
| 4,816,974 | A | 3/1989 | Gordin |
| 4,931,912 | A | 6/1990 | Kawakami et al. |
| 4,947,303 | A | 8/1990 | Gordin et al. |
| 5,016,151 | A | 5/1991 | Mula |
| 5,143,446 | A | 9/1992 | Barnes et al. |
| 5,161,883 | A | 11/1992 | Gordin et al. |
| 5,415,927 | A | 5/1995 | Hirayama et al. |
| 5,506,761 | A | 4/1996 | Strauss et al. |
| 5,600,537 | A | 2/1997 | Gordin et al. |
| 5,630,661 | A | 5/1997 | Fox |
| 5,647,661 | A | 7/1997 | Gordin |
| 5,651,606 | A | 7/1997 | Krogman |
| 5,760,531 | A | 6/1998 | Pederson et al. |
| 5,816,691 | A | 10/1998 | Gordin et al. |
| 5,856,721 | A | 1/1999 | Gordin et al. |
| 6,036,338 | A | 3/2000 | Gordin |
| 6,179,456 | B1 | 1/2001 | Nakamura et al. |
| 6,190,023 | B1 | 2/2001 | Leadford et al. |
| 6,203,176 | B1 | 3/2001 | Gordin |
| 6,206,546 | B1 | 3/2001 | Krogman |
| 6,254,252 | B1 | 7/2001 | Coushaine et al. |
| 6,435,702 | B1 | 8/2002 | Aikawa et al. |
| 6,497,507 | B1 | 12/2002 | Weber |
| 6,502,965 | B1 | 1/2003 | Bradford |
| 6,520,650 | B2 | 2/2003 | Fraizer |
| 6,550,938 | B2 | 4/2003 | Hamilton et al. |
| 6,833,675 | B2 | 12/2004 | Gordin |
| 2001/0007695 | A1 | 7/2001 | Aikawa et al. |
| 2004/0037073 | A1 | 2/2004 | Yang et al. |
| 2007/0139948 | A1 | 6/2007 | Rawlings et al. |

FOREIGN PATENT DOCUMENTS

| | | | |
|---|---|---|---|
| EP | 1172839 | A2 | 1/2002 |
| WO | 9905699 | A | 2/1999 |
| WO | PCT/US/2006001568 | | 5/2006 |

* cited by examiner

SECTION A-A

DETAIL A

DETAIL A - ENLARGED

DETAIL B

DETAIL A

SECTION A-A

SECTION A-A

SECTION A-A

APPARATUS AND METHOD FOR ELIMINATING OUTGASSING OF SPORTS LIGHTING FIXTURES

CROSS REFERENCE TO RELATED APPLICATIONS

This application is a divisional application of U.S. patent application Ser. No. 12/394,922 filed on Feb. 27, 2009, which is a continuation of U.S. Ser. No. 11/334,141 filed Jan. 18, 2006, now U.S. Pat. No. 7,527,393 issued on May 5, 2009, which application claims priority under 35 U.S.C. §119 of a provisional application U.S. Ser. No. 60/644,638 filed Jan. 18, 2005, herein incorporated by reference in its entirety. This application is also a non-provisional of the following provisional U.S. applications, all filed Jan. 18, 2005: U.S. Ser. No. 60/644,639; U.S. Ser. No. 60/644,536; U.S. Ser. No. 60/644,747; U.S. Ser. No. 60/644,534; U.S. Ser. No. 60/644,720; U.S. Ser. No. 60/644,688; U.S. Ser. No. 60/644,636; U.S. Ser. No. 60/644,517; U.S. Ser. No. 60/644,609; U.S. Ser. No. 60/644,516; U.S. Ser. No. 60/644,546; U.S. Ser. No. 60/644,547; U.S. Ser. No. 60/644,537; U.S. Ser. No. 60/644,637; U.S. Ser. No. 60/644,719; U.S. Ser. No. 60/644,784; U.S. Ser. No. 60/644,687, each of which is herein incorporated by reference in its entirety.

INCORPORATION BY REFERENCE

The contents of the following U.S. Patents are incorporated by reference by their entirety: U.S. Pat. Nos. 4,816,974; 4,947,303; 5,161,883; 5,600,537; 5,816,691; 5,856,721; 6,036,338.

I. BACKGROUND OF THE INVENTION

A. Field of the Invention

The present invention relates to lighting fixtures that produce high intensity, controlled, and concentrated light beams for use at relatively distant targets. In particular, the invention relates to such lighting fixtures, their methods of use, and their use in systems where a plurality of such fixtures are used in combination, usually elevated on poles, to compositely illuminate a target area energy-efficiently, with reduced glare and spill light, and with the capability to lower capital and/or operating costs. One primary example is illumination of a sports field.

B. Problems in the Art

This general configuration of sports lighting fixtures has remained relatively constant over many years because it is a relatively economical and durable design. It represents a reasonable compromise between the desire to economically control high intensity light to a distant target while at the same time minimizing wind load, which is a particularly significant issue when fixtures are elevated out-of-doors to sometimes well over 100 feet in the air. A much larger reflector could control light better. However, the wind load would be impractical.

Efforts have gone towards developing increasingly more powerful lamps for sports lighting. However, while producing more lumen output, they require more electrical power to operate. More light per fixture may reduce the number of fixtures and poles, but would increase the amount of electrical energy per fixture used. A typical sports light may be used only a couple of hours a day, on average. Several decades, at least, is the expected life of a sports lighting system. Therefore, energy costs become significant, particularly over those lengths of time.

Therefore, competing interests and issues provide challenges to sports lighting designers. Some of the interests and issues can be at odds with one another. For example, the need always remains for more economical sports lighting. On the other hand, glare and spill control can actually add cost and/or reduce the amount of light available to light the field. Designers have to balance a number of factors, for example, cost, durability, size, weight, wind load, longevity, and maintenance issues, to name a few. Attempts to advance the art have mainly focused on discrete aspects of sports lighting. For example, computerized design of lighting systems tends to minimize hardware costs and system installation costs but uses conventional lamp and fixture technology, with their weaknesses. Also, larger lumen output lamps produce more light, but are used with conventional fixture technology. A need, therefore, still exists for advancement in the art of sports lighting.

Current wide or large area lighting systems suffer from such things as energy lost in the lighting fixture. The present invention addresses these issues.

II. SUMMARY OF THE INVENTION

One issue addressed by the present invention is the efficient production of light. In particular, the present invention relates to apparatus and methods to reduce outgassing in a high intensity lighting fixture. The heat and light involved in operation of such fixtures can cause outgassing of parts in the fixture, which in turn can precipitate onto the lamp, reflecting surfaces, or lens and block or scatter light that otherwise would be useful at the target for the fixture.

A. Objects, Features, or Advantages, of the Invention

It is therefore a principal object, feature, or advantage of the present invention to present a high intensity lighting fixture, its method of use, and its incorporation into a lighting system, which improves over or solves certain problems and deficiencies in the art.

Other objects, features, or advantages of the present invention include such a fixture, method, or system which can accomplish one or more of the following:

a) increase the amount of useable light at each fixture for a fixed amount of energy.

B. Exemplary Aspects of the Invention

In a still further aspect of the invention, apparatus and methods reduce blockage or dispersion of light in or from the fixture which can result in more useable light at the target for a given amount of energy used. In one example, an apparatus and methods are utilized to reduce outgassing of the lighting fixture. The fixture is assembled in a controlled environment to reduce foreign substances from being inadvertently applied to any reflecting surface, the lamp, or the lens, and is sealed at the factory. Another example includes replacing one or more conventional HID fixture parts with those made of a material that does not outgas. Another example is exchanging air in the interior of the fixture through a filter. Another example is obscuring pieces that might outgas from light, particularly UV light. A reduction in outgassing and/or foreign substances on such surfaces or parts can increase the amount of light emanating from the fixture for the same amount of energy used by the fixture.

These and other objects, features, advantages and aspects of the present invention will become more apparent with reference to the accompanying specification and claims.

III. BRIEF DESCRIPTION OF THE DRAWINGS

FIGS. 1A-G illustrate generally a sports lighting system, and conventional components for a sports lighting system.

Figure 2:
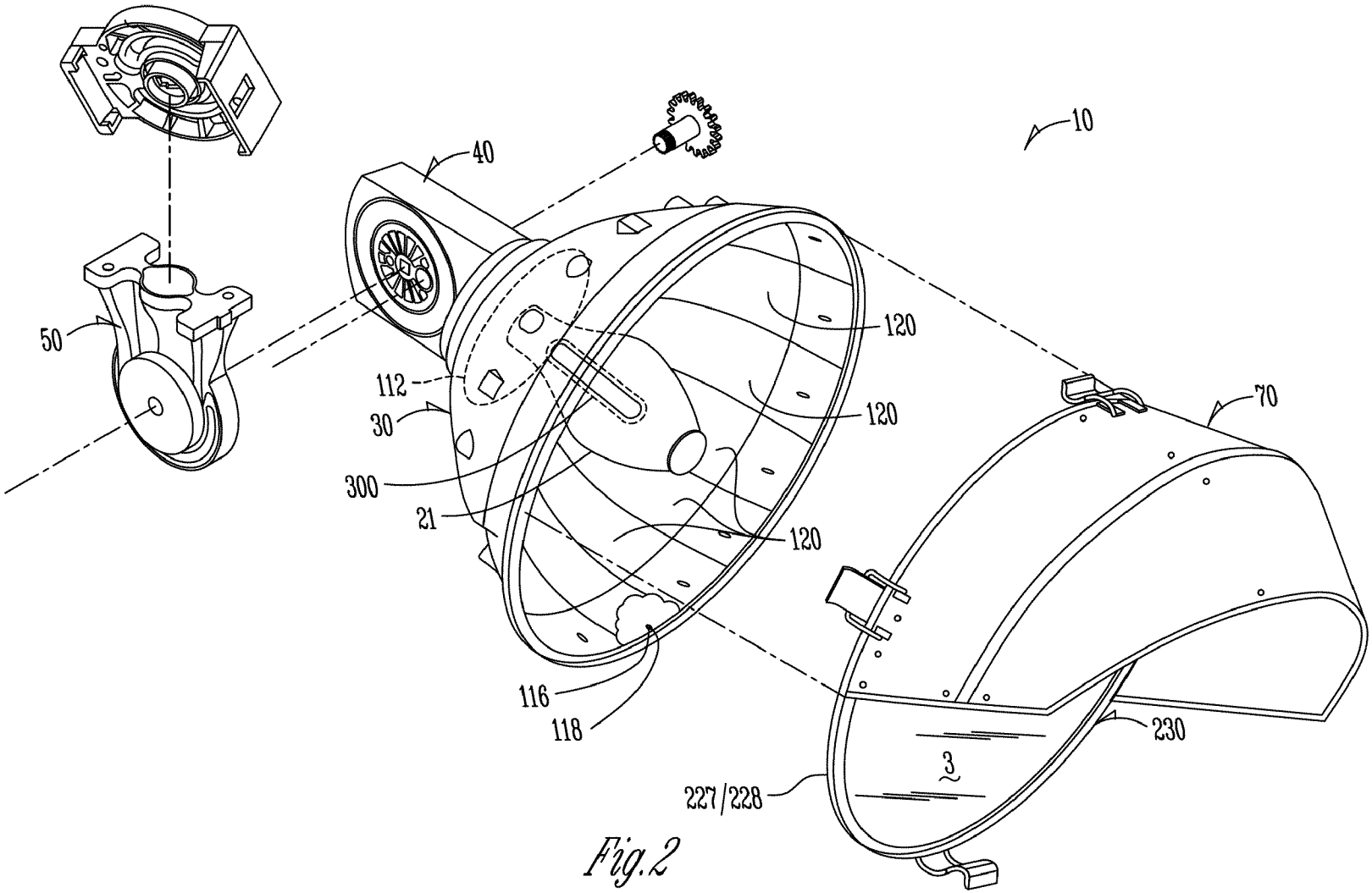

FIG. 2 is a diagrammatic, partial exploded view of a light fixture 10 according to an exemplary embodiment of the present invention.

Figure 3A:
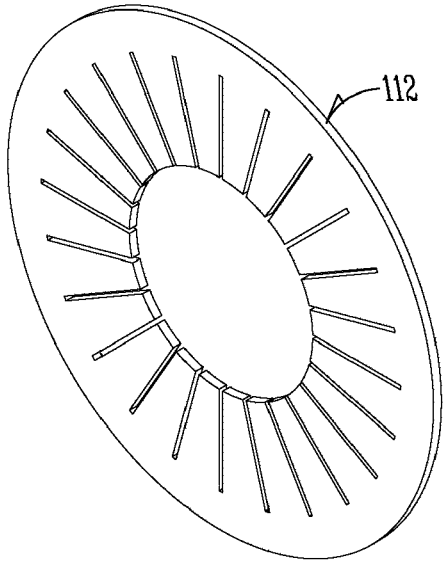
Figure 3B:
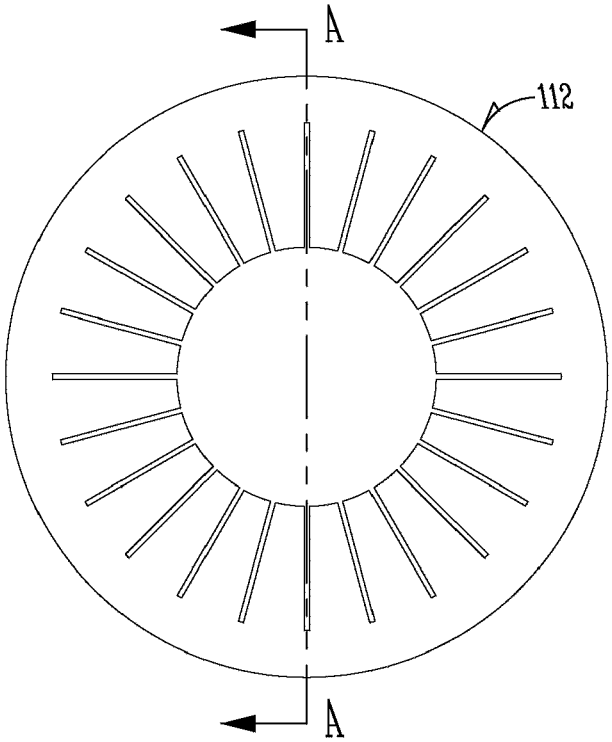
Figure 3C:
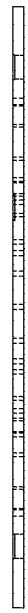

FIGS. 3A-C are views of a piece used with the preferred embodiment.

FIGS. 4A-F are various views of a lens rim adapted to hold a glass lens for the light fixture and to which a visor can be attached.

FIGS. 5A-D are views of a glass rim gasket to seal the lens rim of FIG. 4 to the reflector frame.

Figure 6A:
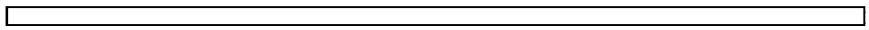
Figure 6B:
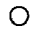

FIGS. 6A-B are a lens rim alignment pin to ensure correct rotational assembly of the lens rim of FIG. 4 to the reflector frame.

Figure 7A:
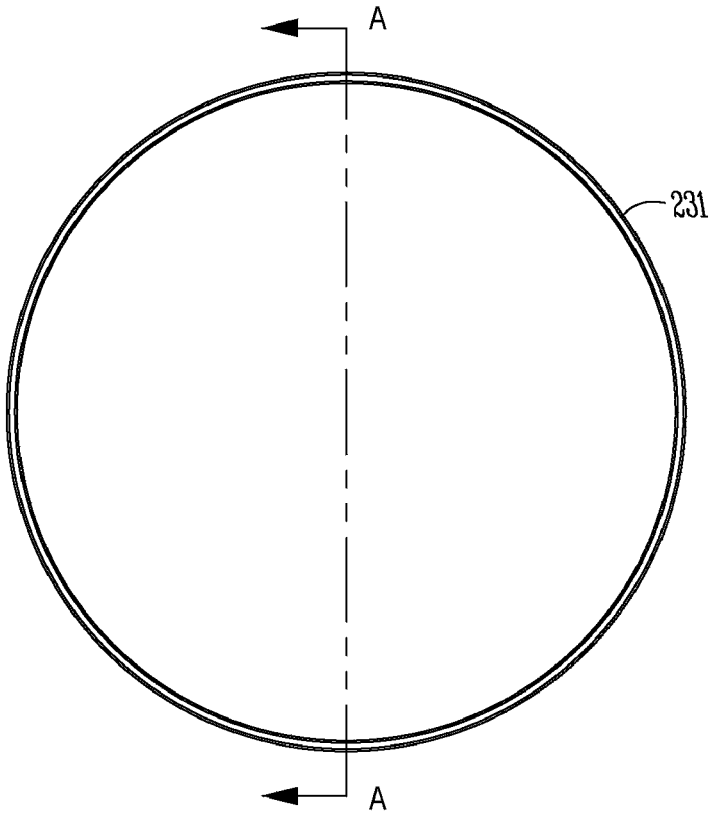
Figure 7B:
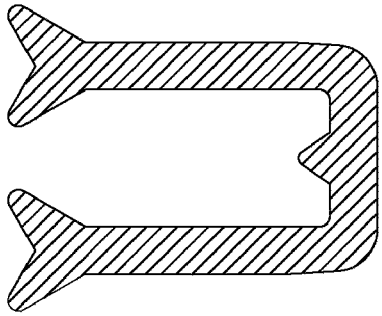
Figure 8A:
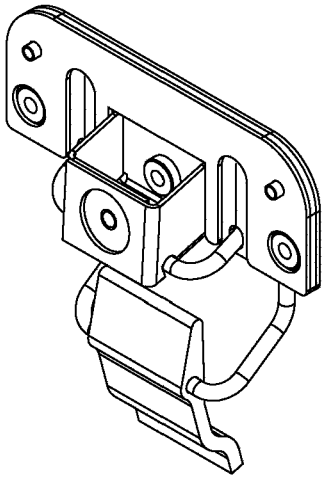
Figure 8C:
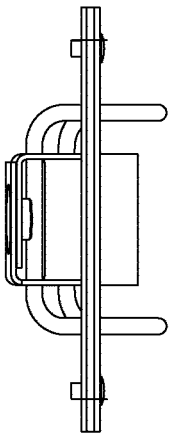
Figure 8B:
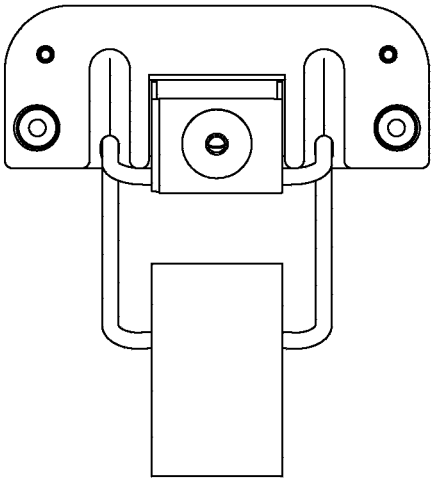
Figure 8D:
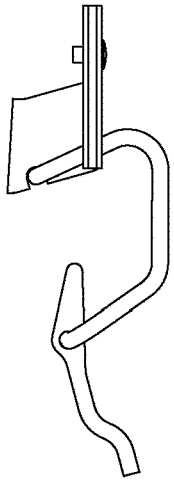
Figure 8E:
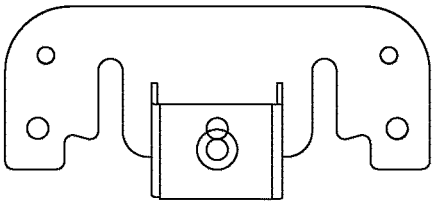

FIGS. 7A-B are a lens gasket to hold and seal the glass lens in the lens rim of FIG. 4.

FIGS. 8A-D, 9 and 10A-C are isolated views of a pivot block, a connector, and a lever for a latch for releasably latching the lens rim of FIG. 4, with glass lens and visor, to a front opening of a reflector frame.

FIGS. 11A-D are various views of a reflector gasket to seal the reflector frame at its connection to the lamp cone.

FIGS. 12A-B, 13A-C, 14A-B, 15A-B, 16A-B, and 17A-B are various views of fasteners useable with various components illustrated in the other drawings.

Figure 18A:
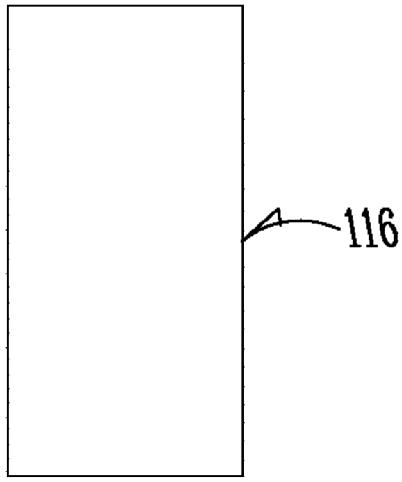
Figure 18B:
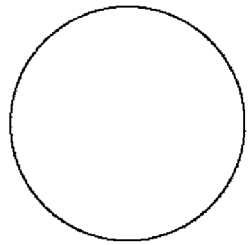

FIGS. 18A and B illustrate a vent filter used with the embodiment.

IV. DETAILED DESCRIPTION OF EXEMPLARY EMBODIMENTS

Figure 1C:
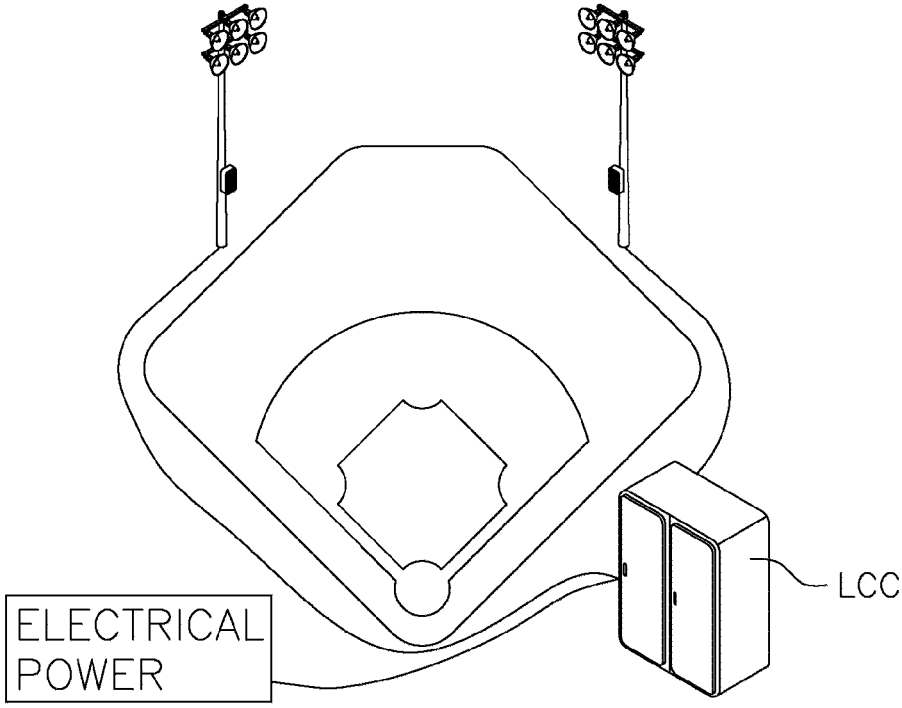
Figure 1D:
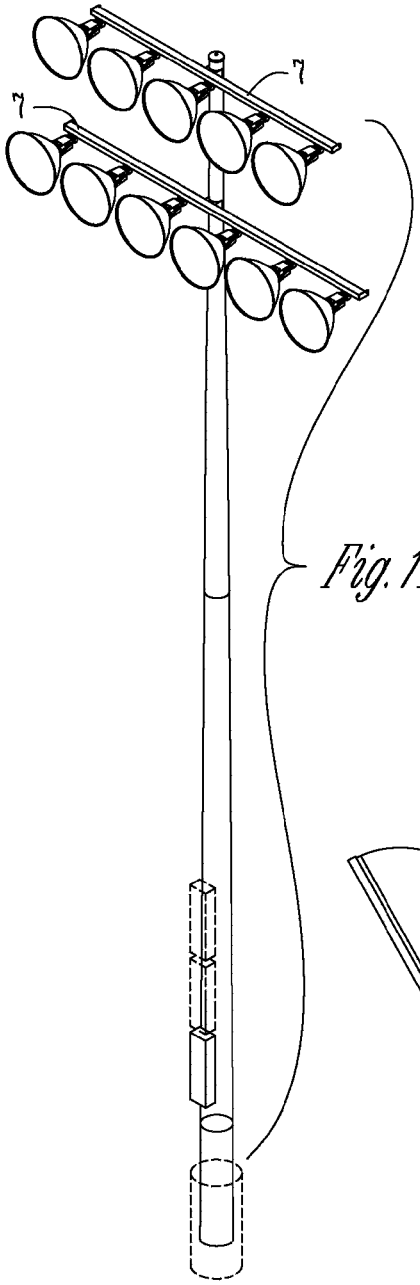
Figure 1G:
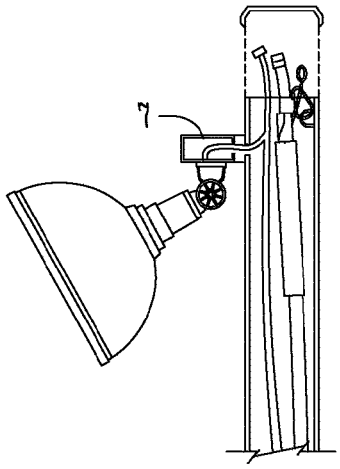
Figure 1E:
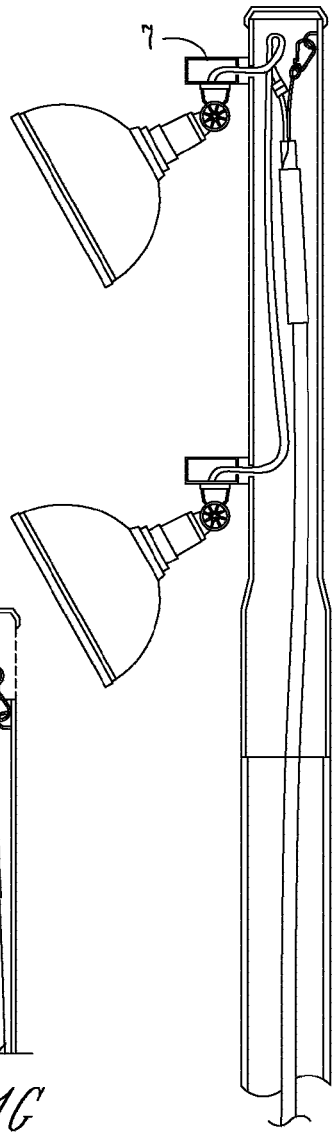
Figure 1F:
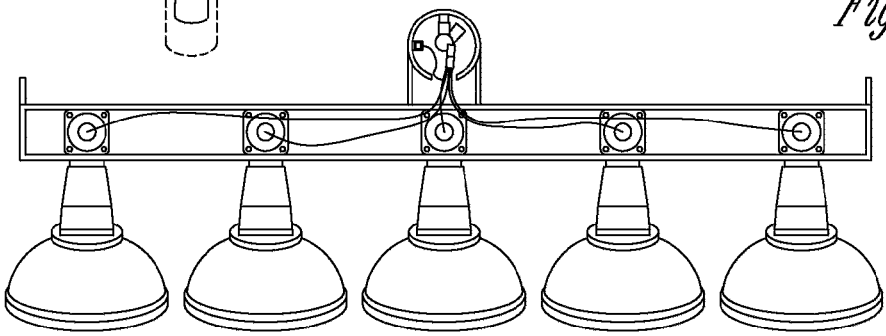

An embodiment of a light fixture will be described in the context of sports lighting, sports lighting fixtures, and sports lighting systems for the illumination of athletic fields such as shown in FIGS. 1A and 1C.

A. Exemplary Apparatus

1. Outgassing Prevention

A source of loss of light from fixture 10 is through degradation of materials in fixture 10. For example, light (and particularly UV light) can break down some materials and cause them to outgas. Outgassing in fixture 10 is reduced or minimized in the following ways:

(a) Assembly of fixture 10 at the factory. Even fingerprints leave residue that can either reduce efficiency of reflecting or light transmitting surfaces (and thus loss light) or cause outgassing during lamp operation (which can leave precipitated residue on reflecting surfaces or the lens and thus block light from fixture). Careful factory assembly can avoid dirt or fingerprints on interior reflecting surfaces. And complete factory assembly of fixture 10, sealing it up prior to shipment to its installation site, reduces the risk an installer at the field will create outgassing issues. The installer does not need to access an interior part of fixture 10 or handle lens 34. They just take fixture 10 out of a shipping box, avoid touching lens 34, and attach it to its appropriate knuckle plate on a cross arm 7.

(b) Seal holes in fixture. Sealing of openings to the interior of the fixture (leaving only a filter for air exchange) are similarly helpful. Examples are gaskets at openings in the lamp cone, between the lamp cone and the reflector frame, and between the glass lens and the reflector frame. In particular, in the exemplary embodiment, the glass lens is in a metal lens rim 230 which can be seated into a shoulder around the perimeter opening to reflector frame 30 and sealed with a gasket 237 between the two. Another gasket 231 seals the glass lens 3 to the lens rim 230. Moreover, if lens rim 230 has any joint or discontinuity around it, structure is included to make sure it has no gaps and retains its shape to avoid any gaps. Furthermore, gaskets and seals can be utilized between the bulb cone or lamp cone 40 and knuckle 50 (in fact several at different locations can be used).

(c) Hide suspect materials from light. For example, a lens rim gasket 237 seals lens rim or frame 230 against reflector frame 30, and lens gasket 231 seals the lens to lens rim 230 and is recessed or placed under a protector ring and hidden from most if not all direct light (especially U.V. light). More specifically, FIG. 4E, a sectional view of lens rim 230, illustrates how materials are hid from exposure to light. The U-shaped lens gasket channel 236 receives U-shaped lens gasket 231 (FIGS. 7A and B). The metal walls defining channel 236 are intentionally designed to extend to their distal edges sufficiently farther than the distal edges of gasket 231 such that it is substantially "hidden" from light directly emanating from the light fixture in the picture. Since this configuration at least minimizes the area or portion of gasket 231 which light, and especially UV light, which can hit. Note also the V or Y-shaped distal ends of gasket 231. These are designed to provide a better seal when glass lens 3 is inserted therein, and also a better seal against the interior walls of channel 236. Still further, note the pointed portion of gasket 231 in FIG. 7B at the bottom of the interior glass-edge-receiving-part of gasket 231. It is also designed to provide a better seal of the edge of glass lens 3.

Figure 4A:
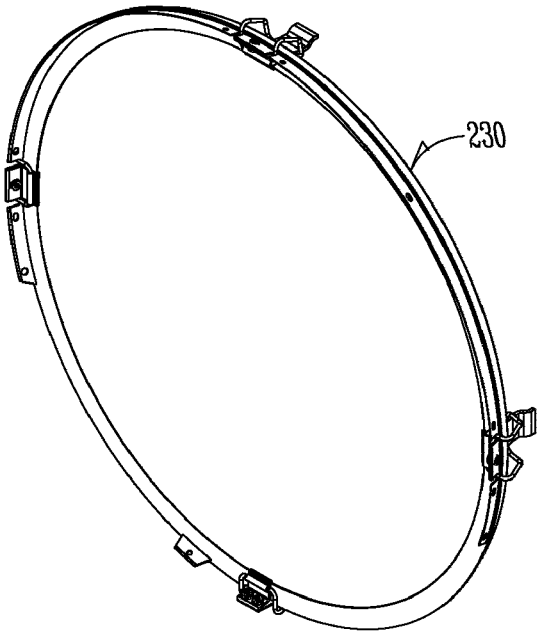
Figure 4B:
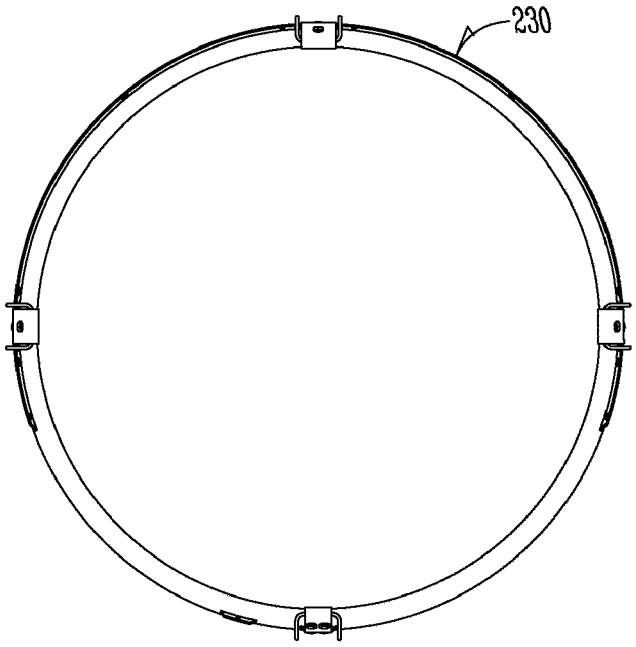
Figure 4C:
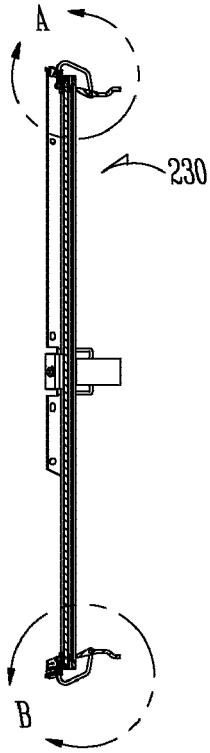
Figure 4D:
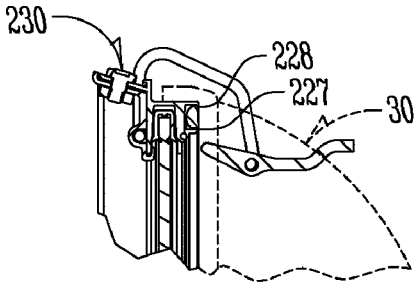
Figure 4E:
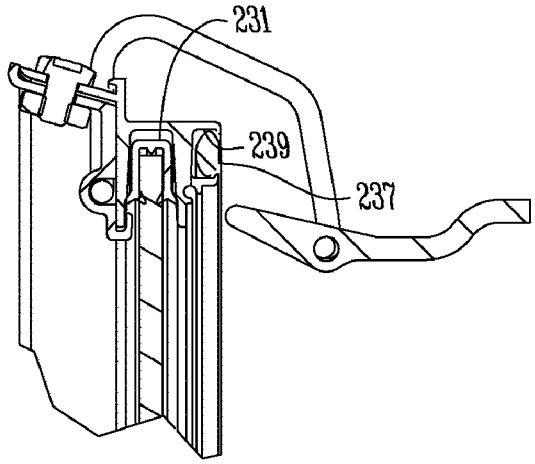
Figure 4F:
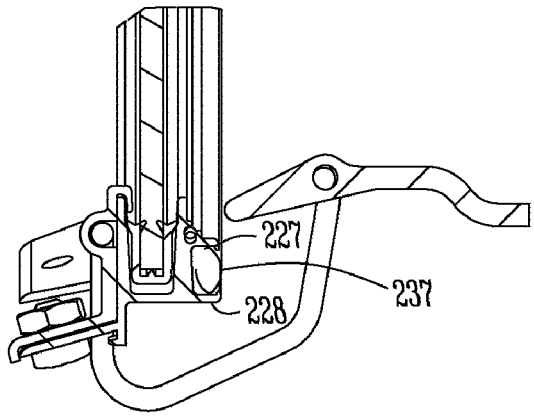
Figure 5A:
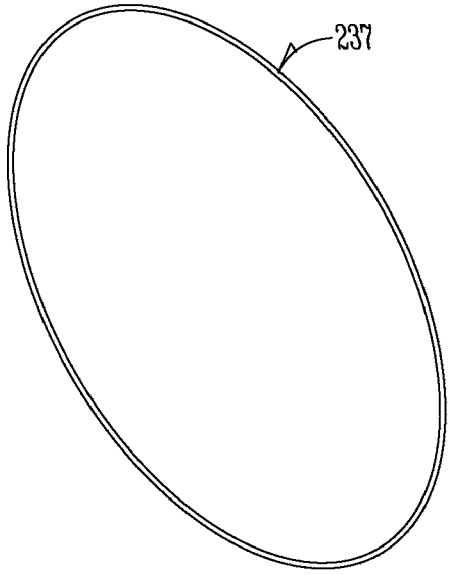
Figure 5D:
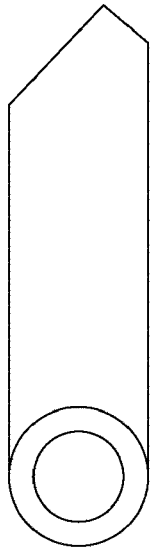
Figure 5B:
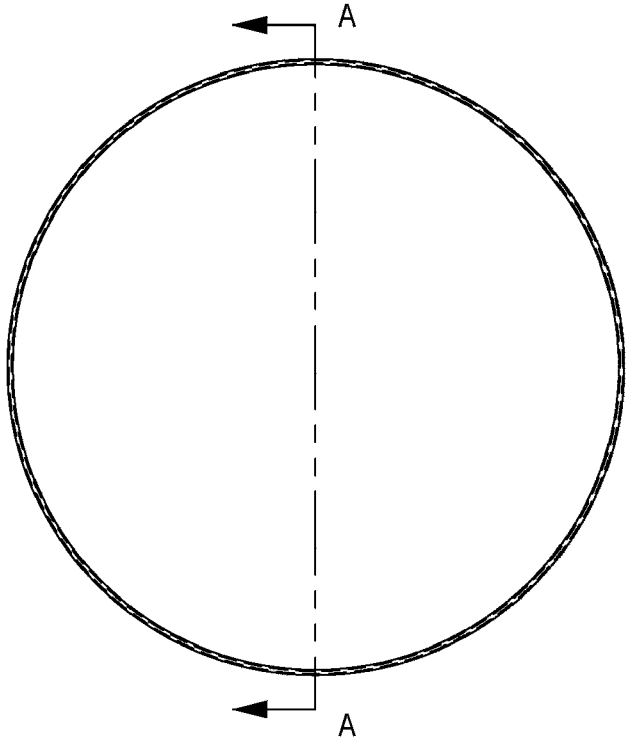
Figure 5C:
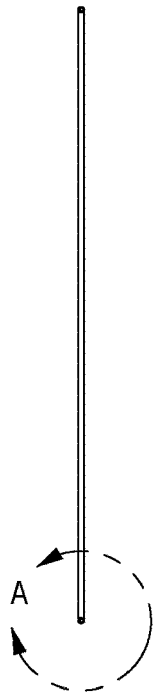

Another example is a second gasket 237 which is adapted to fit within the C-shaped-in-cross-section channel 239 (see FIG. 4E, the cross section of lens rim 230). The opposite walls of C-channel 239 retain the O-ring gasket 237 (see FIGS. 5A-D) when the glass lens and lens rim 230 are removed from the fixture, but also are configured to come into abutment with a ledge or seat formed in the perimeter of reflector frame 30 such that gasket 237 would be completely hidden from light generated by the fixture when lens rim 230 is seated onto reflector frame 30. Moreover, the distal ends of the opposite walls of C-channel 239 would help keep gasket 237 cooler, thus deter outgassing of that gasket, because of metal-to-metal contact between metal lens rim 230 and metal lens frame 30. Those distal ends or abutment points 227 and 228 extend all around lens rim 230 and would help conduct heat from lens rim 230 to reflector frame 30 when installed because of the metal-to-metal contact. The size and surface area of reflector frame 30 would act as a heat radiator of the heat conducted from rim 230. Gasket 237 would compress and allow the metal-to-metal abutment, and thus also the complete hiding of gasket 237.

Figure 9:
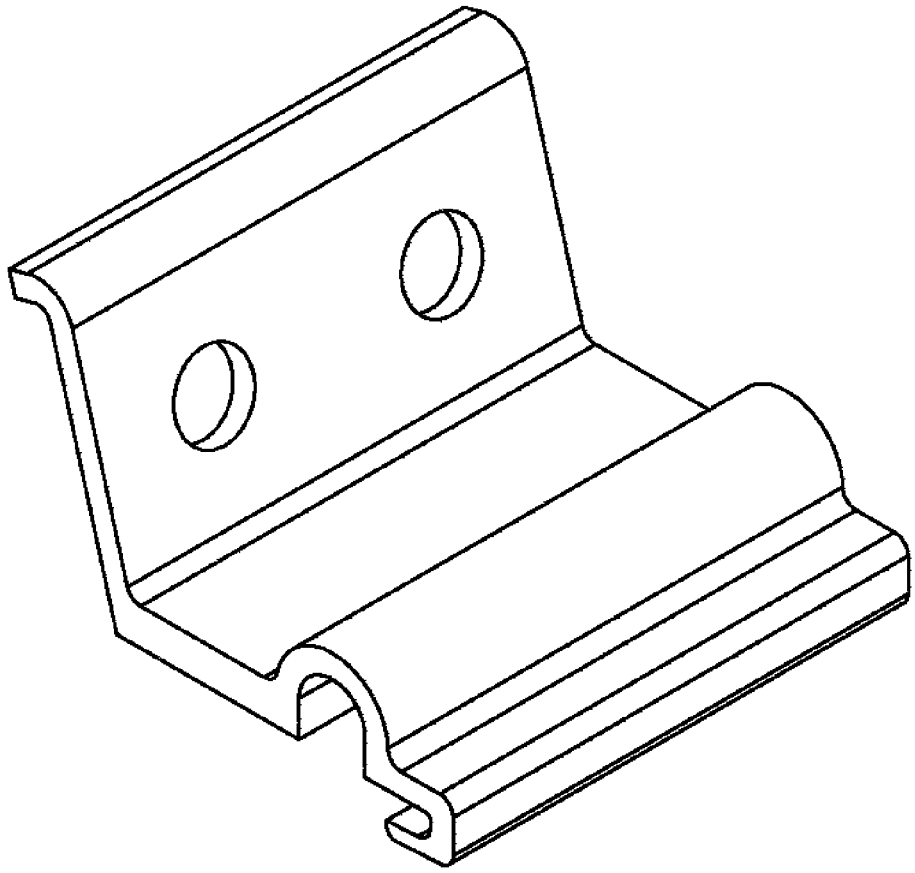
Figure 10A:
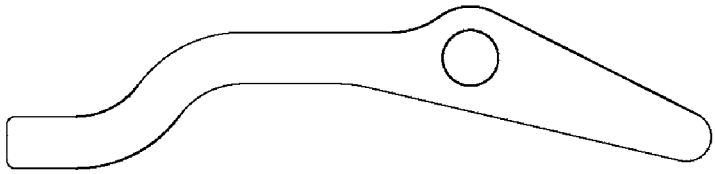
Figure 10B:
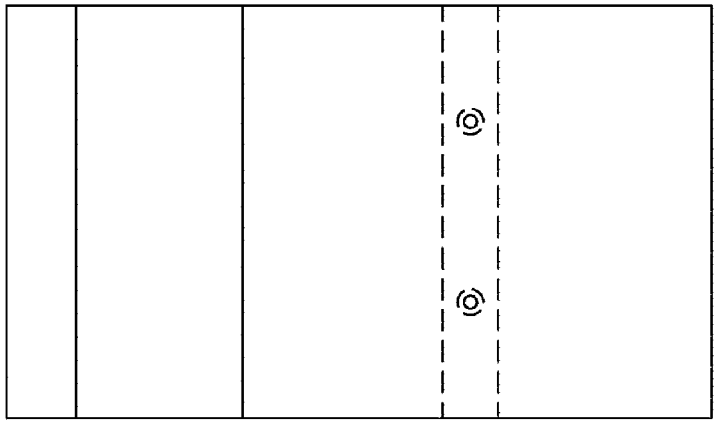
Figure 10C:
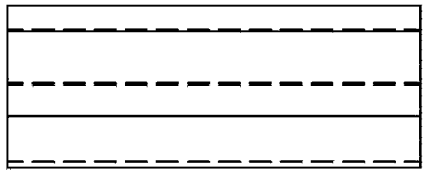
Figure 11A:
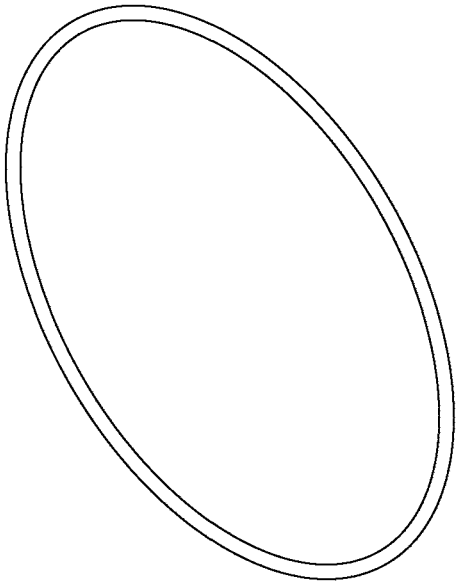
Figure 11D:
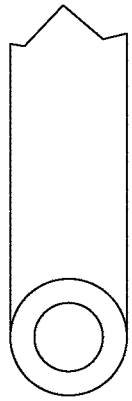
Figure 11B:
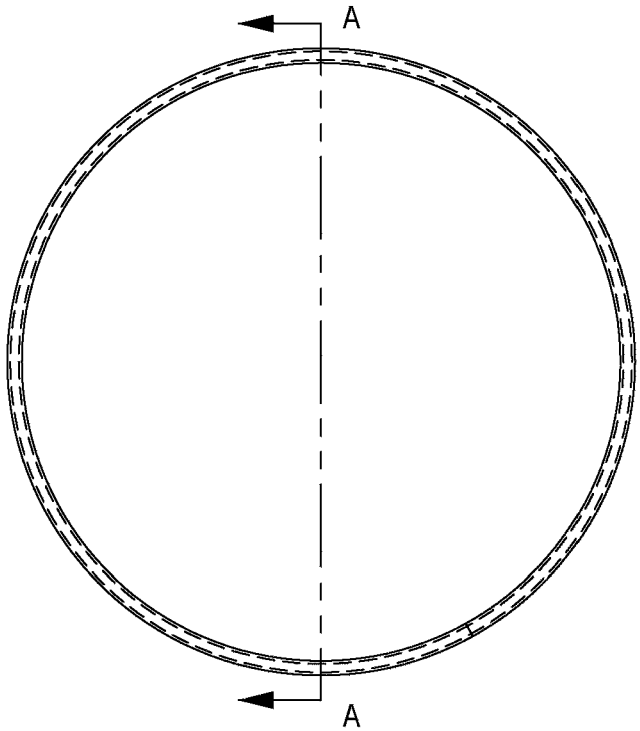
Figure 11C:
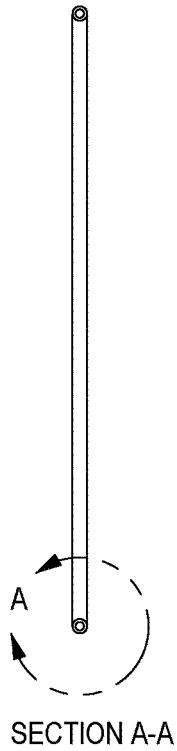
Figure 12A:
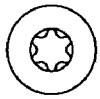
Figure 12B:
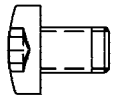
Figure 13A:
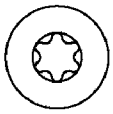
Figure 13B:
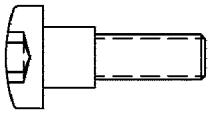
Figure 13C:
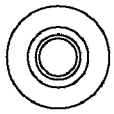

(d) Use materials that do not outgas. An example is Teflon™ centering ring 112 (see FIGS. 3A and B). FIGS. 12-17 show pieces of the fixture that are metal and thus not prone to outgassing that could be used to attach lens rim 230 to reflector frame 30 (including a lens rim screw, and the lens ring rivet, as well as other components). FIGS. 8-10 illustrate metal pieces that can clamp the lens rim 230 to reflector frame 30. A gasket could be used with that latch but metal could be used to cover it and try to hide it from direct UV light. UV light is known to cause outgassing of certain materials. Also temperature can do so.

(e) Minimize U.V. light. For example, a U.V. absorbing, blocking, or reflecting coating could be applied to the arc tube body to block U.V. at the source. Such coatings are known in the art. See Musco U.S. Pat. No. 6,833,675 which is incorporated by reference.

(f) Use a carbonated filter (FIGS. 18A and B) in the only air exchange opening for the interior of reflector frame 30. Less light from outgassing will occur if a constant clean air supply is moved through fixture 10. Placement of the opening for the filter (which would be made of a material that filters undesirable substances), could be placed at the perimeter of reflector frame 30, be relatively small, and be substantially hidden from direct light.

It has been found that such modifications can greatly diminish deposition of outgassed materials on the inside of fixture lens and on reflective surfaces which would tend to create loss of light from fixture 10. Thus, reduction of outgassing will reduce light loss over time, reduce maintenance, reduce amount of energy put in, and could extend lamp life perhaps by double.

It is important to have a "clean" optic system. There can be outgassing, even from conventional parts of such fixtures. Silicone gaskets, plastic pieces, and even glue can outgas. If the fixture is sealed before shipment to installation site, and the above steps taken, outgassing can be greatly reduced. The installation contractor can not create outgassing or light reduction problems by handling interior parts of fixture 10. Additionally, the peel-off covers on the high reflectance reflector inserts 120 protect against residue on the interior reflecting surfaces during factory assembly, which later could block light or outgas.

An additional optional method to try to reduce light loss would be to deter collection of dust or dirt or other substances or particles on the lens. Commercial products like Rain-X® (Sopus Products, Houston, Tex.) could be applied in a thin layer to lens 34 to reduce accumulation of dust and dirt. Some thin films are available commercially for the same function. Other hydrophobic coatings or layers are commercially available. Reduction of dust and dirt could save several percent light loss from fixture 10, and thus increase light to the field for the same energy used. Keeping substances from adhering to the glass reduces reflections caused by such substances or particles. Such reflections are virtually uncontrollable so they can cause glare.

The above-identified structures and steps can be advantageously combined with manufacturing techniques to minimize outgassing. For example, assembling the fixture 10 in a reasonably controlled factory environment, instead at the site of the lighting system (a "construction" environment), can greatly decrease dirt, debris, and other substances from getting on or into fixture 10. The factory environment can be somewhat of a "clean room" compared to outside at the construction site for building an outdoor sports lighting system. Workers can be trained to carefully handle the fixture components when assembling them to avoid getting extraneous substances on the interior parts or surfaces. Even fingerprints or smudges could detrimentally affect the reflecting surfaces. The chance for contamination and effect on performance of the fixture 10 are greatly reduced. Such steps get rid of many variables that could be detrimental to the performance of fixture 10. The worker(s) can assemble fixture 10 and seal its interior in the factory. Use of recessed gaskets and other materials used, along with assembling procedures and environment prevent deterioration of the optic system which might outgas or absorb or reflect light in an uncontrollable manner (and thus lose light to the target space or create glare or spill light). This manufacturing regimen is easy to teach workers and can be easily replicated from fixture to fixture. It is therefore highly repeatable for consistency. It also allows assembly workers to produce a sophisticated combination without having to have sophisticated knowledge about how the components and features work. Labor costs can be reduced. Another feature is than the lens gasket can have metal-to-metal contact to dissipate heat from it (it uses the larger surface of the reflector frame as a heat sink), as well as block light reaching it, both of which could cause outgassing. Significant temperature reduction can be achieved as compared to having it exposed and simply insulated. One example is having metal-to-metal contact between the metal rim that holds the glass lens and the metal reflector frame. A relatively thin gasket could be used between the glass lens and the rim, but the metal-to-metal contact could conduct away heat from the glass lens, using the relatively large reflector frame as a heat sink.

The die cast reflector frame could be outgassed before fixture 10 is assembled (e.g. by placing in oven at temperature (e.g. 450 degrees F.) above what it will normally experience during operation.

B. Assembly and Use

Other parts, including those specifically described above, are assembled, to complete each fixture 10 for the given lighting system, including latching the lens 54/visor 70 combination over reflector frame 30, and sealing all holes except for placement of filter in its designated opening. The assembly worker(s) take appropriate measures to avoid any foreign substances from adhering or being inside reflector frame 30 after lens 54/visor 70 is sealingly mounted to it. This includes peeling away the release sheet protective covers on the high reflectivity inserts for reflector frame 30 and visor 70.

Fixtures 10, a pole top with pre-assembled cross arms 7, and poles are shipped to the field to be lighted, along with aiming diagrams, showing how each pre-designed fixture should be aimed relative the field. The entire system, namely poles and bases for the poles, cross arms, fixtures, wiring, ballast boxes, etc. can substantially pre-assembled at the factory (see Musco U.S. Pat. No. 5,600,537, incorporated by reference herein). This pre-assembled system is available from Musco Corporation under the Light Structure™ brand name.

C. Options and Alternatives

It will be appreciated that the foregoing exemplary embodiment is given by way of example only and not by way of limitation. Variations obvious to those skilled in the art will be included in the invention. The scope of the invention is defined solely by the claims.

For example, variations in dimensions, materials, and combinations are contemplated by the invention. In particular, all of the features and aspects of the exemplary embodiment are not required to produce a beneficial or advantageous result.

1. Application Alternatives

The invention can be utilized for other wide area lighting applications other than sports lighting. A few examples are parking lot lighting, architectural lighting, public event lighting, arena or stadium lighting. It can be applied to interior lighting. It is relevant to any HID fixture where a controlled concentrated beam is desired or needed. This includes to a relatively distant (e.g. on the order of 100 feet or more) target, or for special effects lighting.

2. Other Options, Alternatives, and Concepts

It will be appreciated that the present invention addresses a discovery that can produce meaningful advantages. As stated, in sports lighting for example, it addresses a subtle form of lumen depreciation.

As can be seen by referring to the appended figures, the invention can address one or several different potential sources for lumen depreciation other than the well-known lamp lumen depreciation, where over operating time, the lumen output of a lamp diminishes according to a predictable function.

It will be appreciated that the present invention therefore can take many forms and embodiments. One of the method steps can be practiced to assist in reduction of light loss other than lamp lumen depreciation. Or, combinations of steps, of a nature disclosed, can be practiced, which in most cases would have the potential for further decreasing lumen depreciation from the fixture.

Figure 14A:
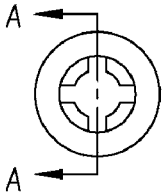
Figure 14B:
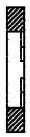
Figure 15A:
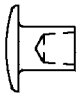
Figure 15B:
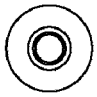
Figure 16A:
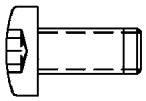
Figure 16B:
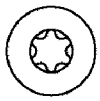
Figure 17A:
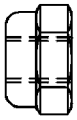
Figure 17B:
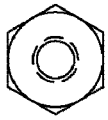

One methodology is to carefully design and select the materials that are used with the fixture, especially those materials that come into contact with, or otherwise are impacted by thermal or light energy from operation of the fixture. FIGS. 3A and B show special materials for centering ring 112 (FIGS. 14A and B). FIGS. 18A and B illustrate a reflector vent filter of material selected to resist or not outgas. Other figures show examples of gaskets or other materials which, if not selected appropriately, could outgas.

Secondly, manufacturing assembly steps can be designed to reduce or eliminate substances, even inadvertent substances that could cause lumen depreciation.

Third, by design of the structural cooperation of parts of the fixture, certain pieces that have the propensity to outgas can be insulated or shielded from energy that could cause the outgassing.

As can be seen from the figures, one technique for hiding material from UV light and keeping heat away from the material, to try to reduce or eliminating outgassing of certain materials is as follows. Many conventional lighting fixtures utilize a single gasket to seal the lens. As shown in FIG. 4, the geometry of the lens rim 230 uses one gasket to seal the reflector in a U-shaped channel, and an O-ring second gasket. Essentially what use to be one gasket is broken up into two. The geometry of the ring that holds the glass both hides the gaskets from UV radiation and creates metal-to-metal contact that can conduct heat away from the rings and allow it to disperse into the reflector frame. This is a part of keeping heat away and thus reducing outgassing.

What is claimed is:

1. A method for assembling a high intensity lighting fixture comprising:

a. providing a controlled assembly environment that minimizes dirt and contaminants;

b. handling components for assembly with techniques to minimize transfer of dirt or contaminants from workers to surfaces of the components;

c. sealing the interior of the fixture at assembly and sealing substantially all gaps allowing only air exchange through a filter.

2. The method of claim 1 further comprising adding peal-off or release covers to one or more exterior surfaces of the fixture after assembly at the factory.

3. The method of claim 1 further comprising outgassing components that would normally outgas prior to assembly.

4. The method of claim 1 further comprising shipping the assembled and sealed fixture.

5. The method of claim 1 further comprising shielding components that outgas from light.

6. The method of claim 1 further comprising creating a heat sink to draw heat away at or near components that outgas.

* * * * *